US009829827B2

(12) United States Patent
Arai et al.

(10) Patent No.: US 9,829,827 B2
(45) Date of Patent: Nov. 28, 2017

(54) DEVELOPER CONTAINER AND IMAGE FORMING APPARATUS

(71) Applicant: FUJI XEROX CO., Ltd., Tokyo (JP)

(72) Inventors: Masatoshi Arai, Kanagawa (JP); Ryoji Kawasaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/147,445

(22) Filed: May 5, 2016

(65) Prior Publication Data

US 2017/0160673 A1 Jun. 8, 2017

(30) Foreign Application Priority Data

Dec. 3, 2015 (JP) ..... 2015-236781

(51) Int. Cl.
*G03G 15/08* (2006.01)

(52) U.S. Cl.
CPC ..... *G03G 15/0877* (2013.01)

(58) Field of Classification Search
CPC ..... G03G 2215/067; G03G 2215/0692
See application file for complete search history.

(56) References Cited

U.S. PATENT DOCUMENTS 6,292,644 B1 * 9/2001 Goto ..... G03G 15/0855 222/167
2009/0087215 A1 * 4/2009 Sakuma ..... G03G 15/0898 399/105
2009/0158667 A1 6/2009 Yoshizawa et al.

FOREIGN PATENT DOCUMENTS

JP 06-258878 A 9/1994
JP 2009-205126 A 9/2009
JP 2009-271100 A 11/2009

* cited by examiner

*Primary Examiner* — Victor Verbitsky
(74) *Attorney, Agent, or Firm* — Sughrue Mion, PLLC

(57) ABSTRACT

A developer container including: a container body that contains developer to be supplied to an apparatus body and is capable of being attached to and removed from the apparatus body, the container body having a discharge port through which the developer is discharged; an opening-and-closing member that opens and closes the discharge port in response to relative attachment and removal of the container body to and from the apparatus body; a first elastic member that is provided so as to surround the discharge port and seals between the container body and the opening-and-closing member; and a second elastic member that comes into contact with a leading end of the opening-and-closing member in a direction in which the opening-and-closing member moves when the discharge port is closed.

11 Claims, 11 Drawing Sheets

DEVELOPER CONTAINER AND IMAGE FORMING APPARATUS

CROSS-REFERENCE TO RELATED APPLICATIONS

This application is based on and claims priority under 35 USC 119 from Japanese Patent Application No. 2015-236781 filed Dec. 3, 2015.

BACKGROUND

Technical Field

The present invention relates to a developer container and an image forming apparatus.

SUMMARY

According to an aspect of the invention, there is provided a developer container including: a container body that contains developer to be supplied to an apparatus body and is capable of being attached to and removed from the apparatus body, the container body having a discharge port through which the developer is discharged; an opening-and-closing member that opens and closes the discharge port in response to relative attachment and removal of the container body to and from the apparatus body; a first elastic member that is provided so as to surround the discharge port and seals between the container body and the opening-and-closing member; and a second elastic member that comes into contact with a leading end of the opening-and-closing member in a direction in which the opening-and-closing member moves when the discharge port is closed.

BRIEF DESCRIPTION OF THE DRAWINGS

Exemplary embodiment of the present invention will be described in detail based on the following figures, wherein:

FIGS. 5A to 5E show the detailed structure of the shutter, in which FIG. 5A is a perspective view as viewed from the inner surface, FIG. 5B is a perspective view as viewed from the outer surface, FIG. 5C is a plan view of the inner surface, and FIG. 5D is a plan view of the outer surface, and FIG. 5E is a sectional view;

DETAILED DESCRIPTION

Figure 1:
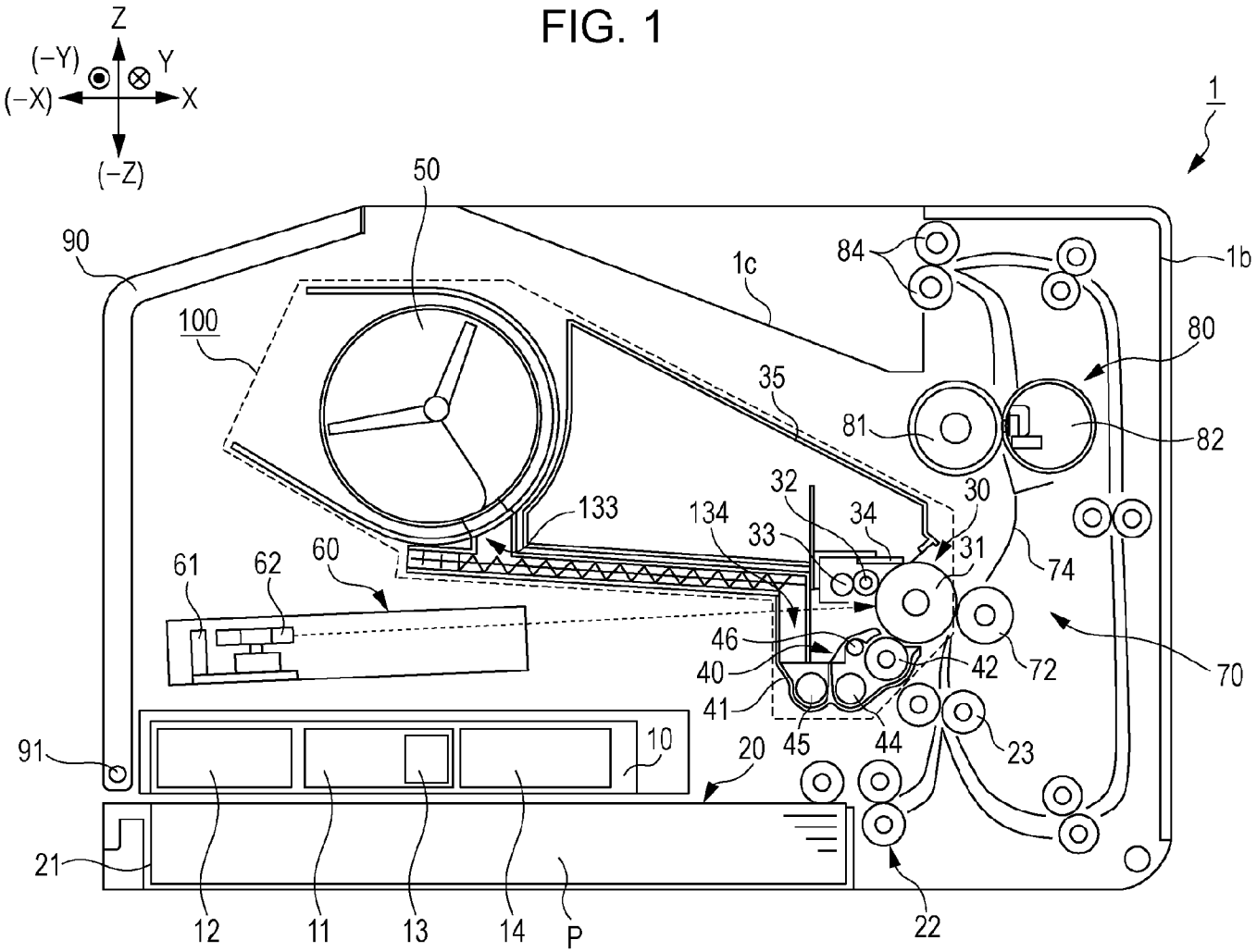
FIG. 1 is a schematic vertical sectional view showing the internal configuration of an image forming apparatus.

The present invention will be described in detail below with reference to the drawings and by using an exemplary embodiment and a specific example. Note that, however, the present invention is not limited thereto.

Also note that the drawings are schematic, and the dimensional ratios in the drawings are different from those in actuality. For the ease of understanding, components that are not needed for explanation are not illustrated, where appropriate.

For the ease of understanding the following description, in the drawings, front-rear, left-right, and top-bottom directions will be illustrated as X-axis, Y-axis, and Z-axis directions, respectively.

1. Overall Configuration and Movement of Image Forming Apparatus

FIG. 1 is a schematic vertical sectional view showing the internal configuration of an image forming apparatus 1 according to this exemplary embodiment.

Referring to the figure, the overall configuration and movement of the image forming apparatus 1 will be described.

The image forming apparatus 1 includes a control device 10, a sheet transport device 20, a photoconductor unit 30, a developing device 40, a toner cartridge 50, serving as an example of a developer container, an exposure device 60, a transfer device 70, and a fixing device 80.

The image forming apparatus 1 has, on the front side thereof, a rotatably supported cover 90, through which the inside of the image forming apparatus 1 is exposed to the front side (in the −X direction) when consumable components are replaced.

The image forming apparatus 1 has, on the rear side thereof, a rotatably supported rear cover 1*b*, through which the inside of the image forming apparatus 1 is exposed when a paper jam occurs or when the inside of the apparatus is inspected.

The image forming apparatus 1 has, on the top surface (Z direction) thereof, a top cover 1*c*, which also serves as an output tray, on which sheets having images recorded thereon are output and stored.

The control device 10 includes an image-forming-apparatus controller 11 that controls the operation of the image forming apparatus 1, a controller unit 12 that prepares image data in response to a print request, an exposure controller 13 that controls the light source of the exposure device 60, a power supply device 14, etc. The power supply device 14 applies voltages to a charging roller 32, a developing roller 42, a transfer roller 72, etc., which will be described below, and supplies power to the exposure device 60.

The controller unit 12 converts image data that is input from an image reading device (not shown) and print information that is input from an external information transmitting device (for example, a personal computer) into image information for forming a latent image and outputs a driving signal to the exposure controller 13 at preset timing.

The sheet transport device 20 is provided at the bottom of the image forming apparatus 1. The sheet transport device 20 includes a paper cassette 21. Multiple sheets P, serving as recording media, are stacked on the top surface of the paper cassette 21. The sheets P, which are positioned by a restricting plate (not shown) with respect to the width direction, are drawn to the rear side (X direction) one-by-one from the top by a sheet pick-up part 22 and are transported to a nip of a registration roller pair 23.

The photoconductor unit 30 is provided above the sheet transport device 20 and includes a photoconductor drum 31 that is rotationally driven inside a unit housing 35. The charging roller 32, the developing device 40, the transfer roller 72, and a cleaning blade 34 are arranged in the rotation direction of the photoconductor drum 31. A cleaning roller 33 for cleaning the surface of the charging roller 32 is disposed so as to oppose and be in contact with the charging roller 32.

The developing device 40 includes a developer housing 41 that contains developer. The developer housing 41 accommodates the developing roller 42 disposed so as to oppose the photoconductor drum 31, and a pair of augers 44 and 45 disposed on the lower rear side of the developing roller 42 to transport the developer toward the developing roller 42 while stirring. A layer restricting roller 46 that restricts the thickness of the developer layer is disposed near the developing roller 42.

The photoconductor unit 30 and the developing device 40 are integrated in the form of a process cartridge 100, and the process cartridge 100 is removably attached to the image forming apparatus 1. As shown in FIG. 1, the process cartridge 100 may be replaced by opening and closing the cover 90, which is provided in a manner capable of being opened and closed, when the photoconductor drum 31 has reached its life expectancy.

The toner cartridge 50 is removably attached to an end of the process cartridge 100 opposite to the end to which the photoconductor unit 30 is attached.

The exposure device 60 includes a laser-beam emitting part 61, serving as a light source, and a rotating polygon mirror 62, which deflects and reflects laser beam LB from the laser-beam emitting part 61. The exposure device 60 scans the surface of the photoconductor drum 31 with a laser beam LB modulated according to the image data of an image to be formed.

The surface of the rotating photoconductor drum 31 is charged by the charging roller 32, and an electrostatic latent image is formed thereon by the exposure device 60. The electrostatic latent image formed on the photoconductor drum 31 is developed, as a toner image, by the developing roller 42.

The transfer device 70 includes the rear cover 1*b*, which supports the transfer roller 72 such that the transfer roller 72 is able to come into and out of contact with the photoconductor drum 31, and the transfer roller 72, which forms a nip with respect to the photoconductor drum 31. A transfer voltage from the power supply device 14, controlled by the image-forming-apparatus controller 11, is applied to the transfer roller 72, and, as a result, the toner image on the photoconductor drum 31 is transferred to a sheet P passing between the photoconductor drum 31 and the transfer roller 72.

The residual toner on the surface of the photoconductor drum 31 is removed by the cleaning blade 34 and is collected in the unit housing 35 that supports the photoconductor drum 31. Then, the surface of the photoconductor drum 31 is charged again by the charging roller 32. The residual toner attached to the charging roller 32 without being removed by the cleaning blade 34 comes into contact with the charging roller 32, is caught by the surface of the rotating cleaning roller 33, and is discharged on the photoconductor drum 31 via the charging roller 32.

The fixing device 80 includes a heating module 81 and a pressure module 82, forming a pair, and the heating module 81 and the pressure module 82 form a fixing nip part (fixing area) at a position where they are pressed against each other.

The sheet P having the toner image transferred thereto by the transfer roller 72 but not yet fixed is transported to the fixing device 80 via the transport guide 74. The sheet P transported to the fixing device 80 is subjected to pressure and heat applied by the heating module 81 and the pressure module 82, and thus, the toner image is fixed. The sheet P having the toner image fixed thereon is output onto the top cover 1*c* of the image forming apparatus 1 through a pair of output rollers 84.

2. Process Cartridge

Figure 2:
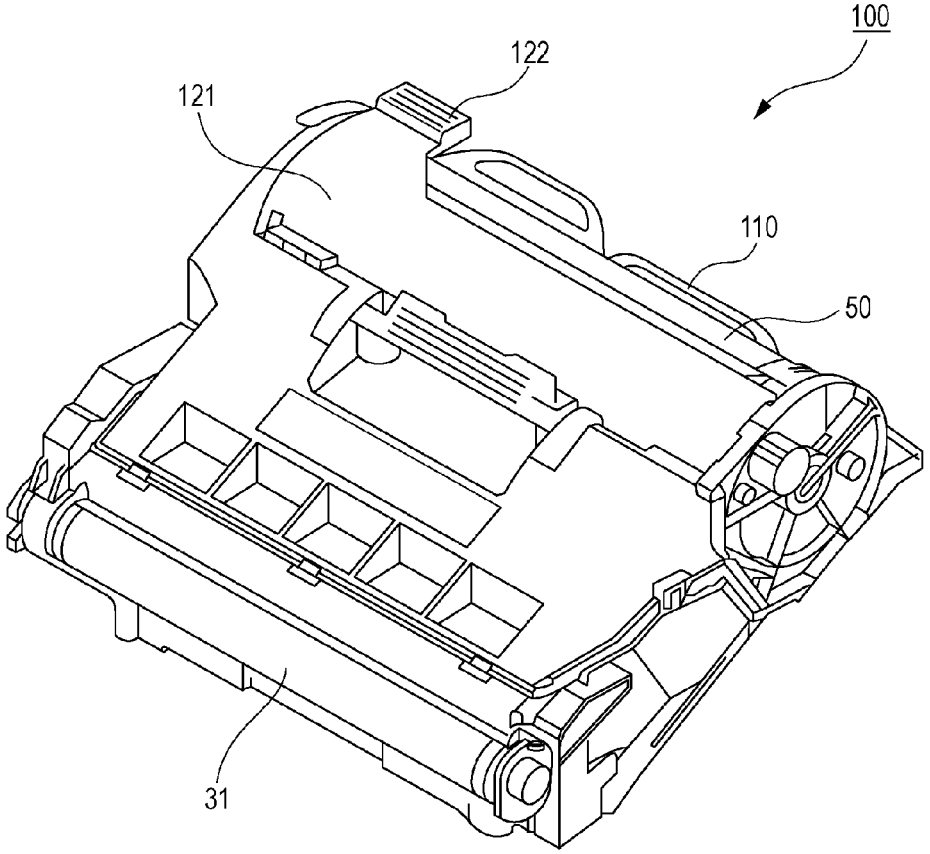
FIG. 2 is a perspective view of a process cartridge.
Figure 3:
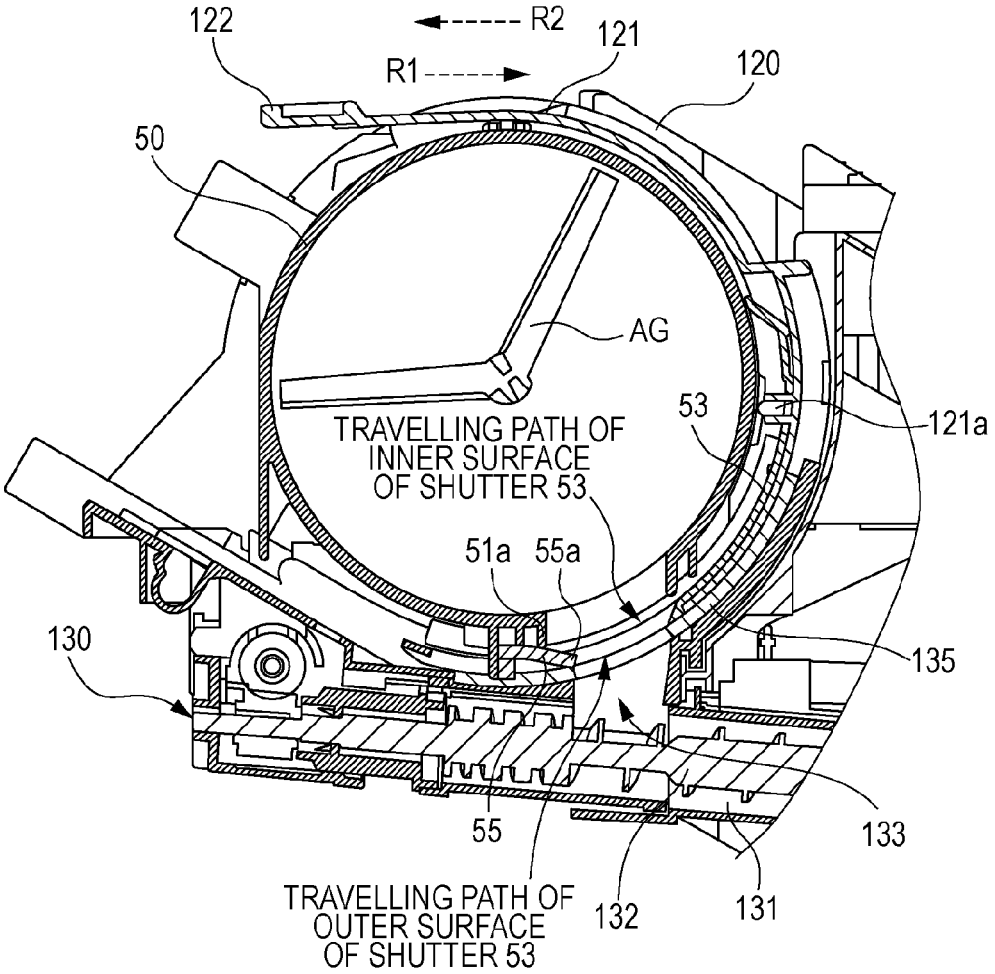
FIG. 3 is a schematic sectional view of a retaining part including a toner cartridge.
Figure 4A:
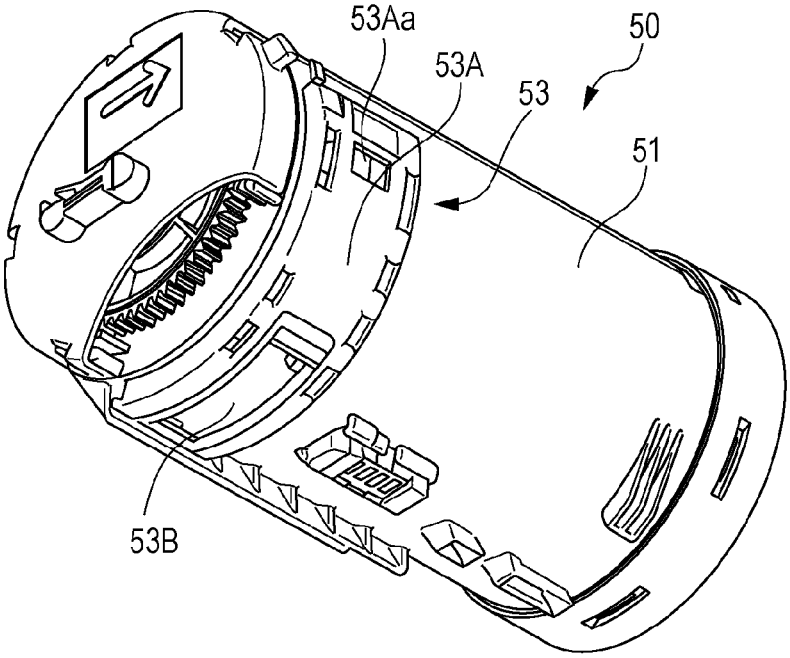
FIGS. 4A and 4B are perspective views of the toner cartridge, in which a shutter is located at a closed position and at an open position, respectively.
Figure 4B:
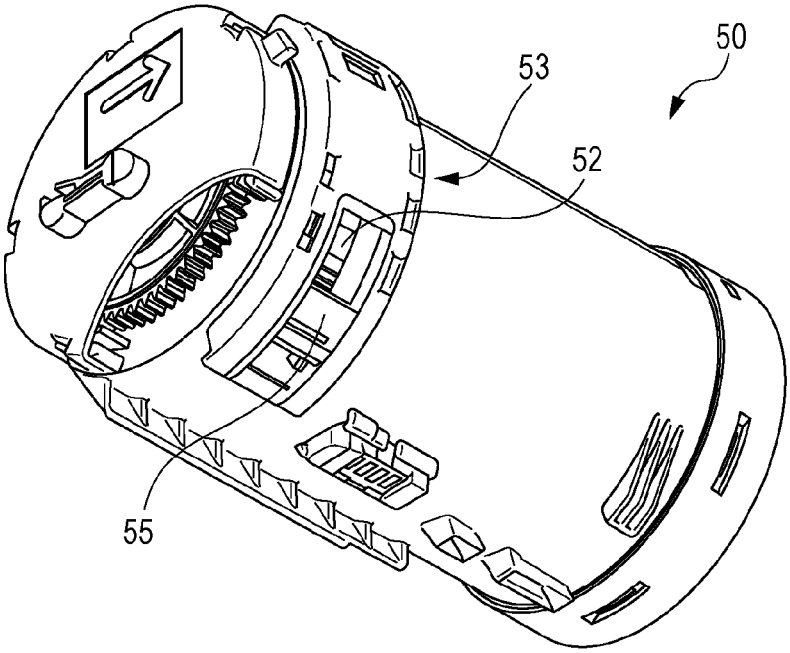
Figure 5A:
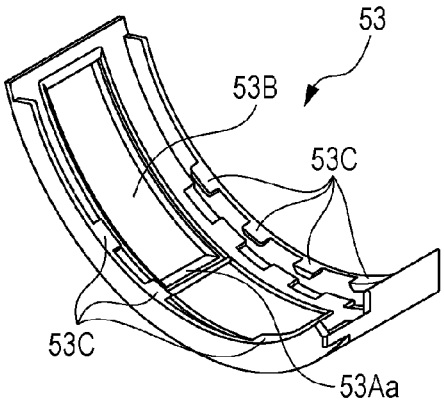
Figure 5B:
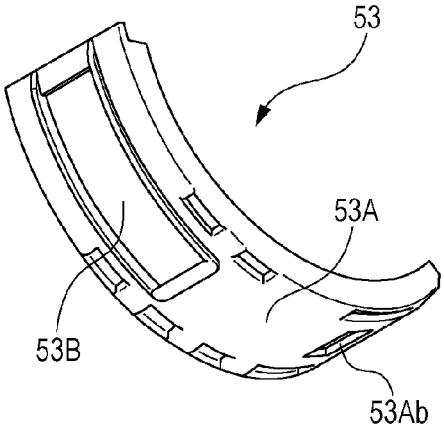
Figure 5C:
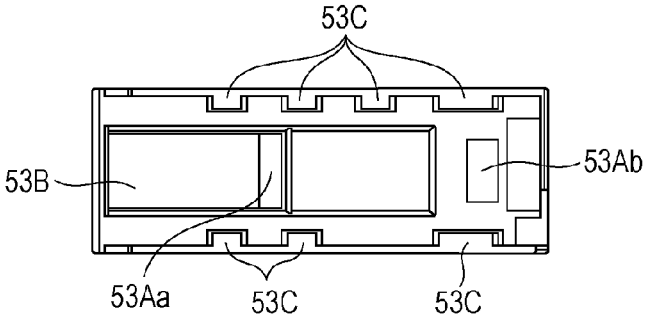
Figure 5D:
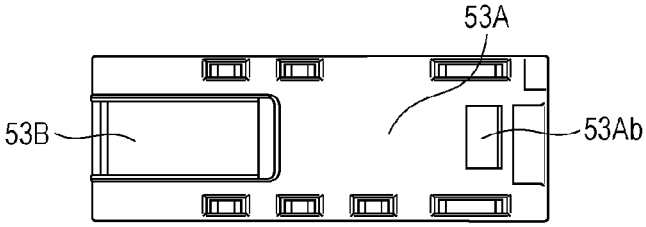
Figure 5E:
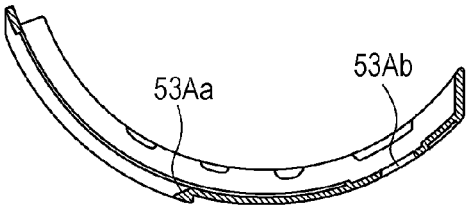
Figure 6:
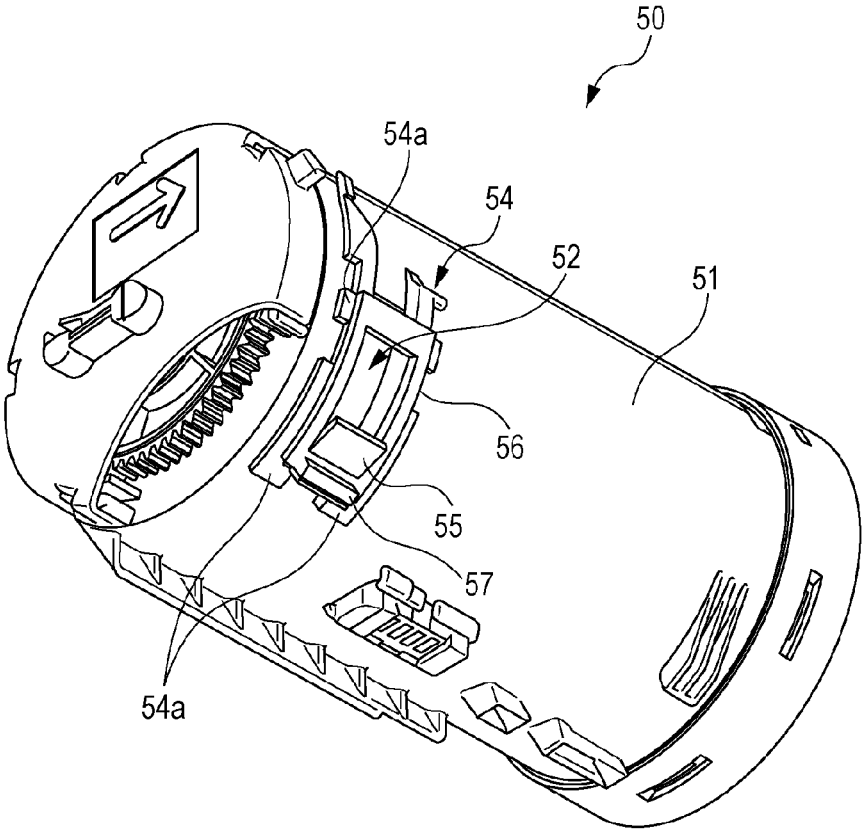
FIG. 6 is a perspective view of a frame, without the shutter.
Figure 7A:
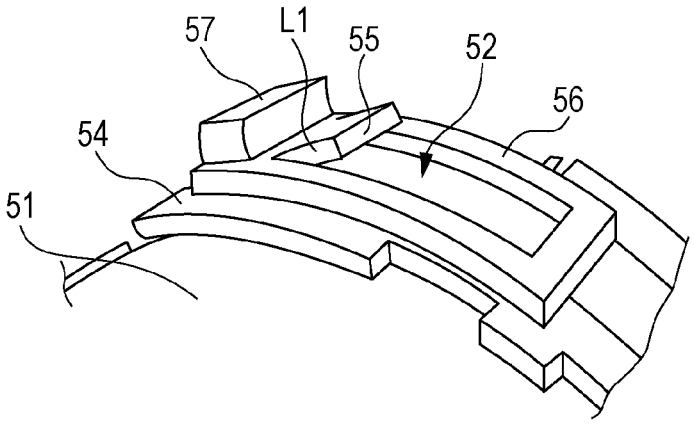
FIGS. 7A and 7B are perspective views showing the structure of the frame and the shutter, showing a state without the shutter and a state with the shutter, respectively.
Figure 7B:
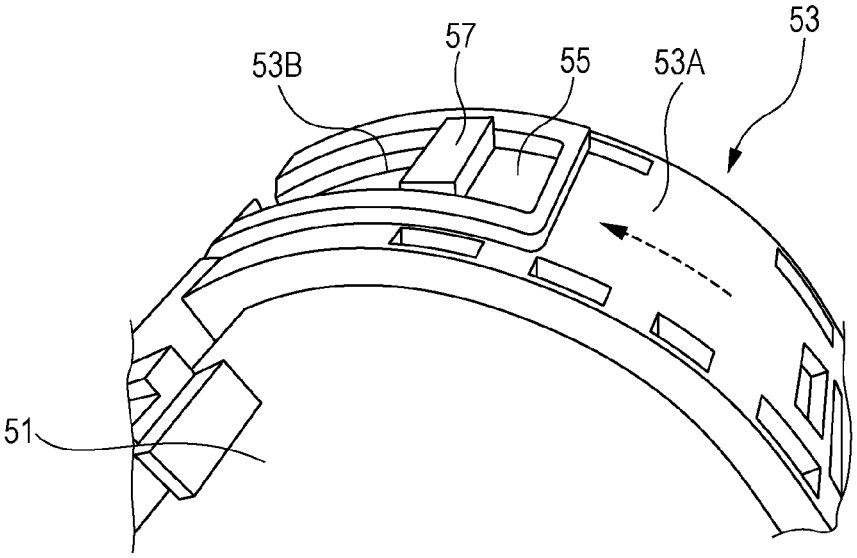

FIG. 2 is a perspective view of the process cartridge 100; FIG. 3 is a schematic sectional view of a retaining part 120 including the toner cartridge 50; FIGS. 4A and 4B are perspective views of the toner cartridge 50, in which a shutter 53 is located at a closed position and at an open position, respectively; FIGS. 5A to 5E show the detailed structure of the shutter 53, in which FIG. 5A is a perspective view as viewed from the inner surface, FIG. 5B is a perspective view as viewed from the outer surface, FIG. 5C is a plan view as viewed from the inner surface, FIG. 5D is a plan view of the outer surface, and FIG. 5E is a sectional view; FIG. 6 is a perspective view of a frame 54, without the shutter 53; and FIGS. 7A and 7B are perspective views showing the structure of the frame 54 and the shutter 53, showing a state without the shutter 53 and a state with the shutter 53.

Referring to these figures, the configuration of the shutter 53 on the toner cartridge 50 will be described.

2.1 Configuration of Process Cartridge

As shown in FIG. 2, the process cartridge 100 has a grip 110, which allows a user to hold when attaching or removing the process cartridge 100 to or from the image forming apparatus 1. The process cartridge 100 is removably attached to the image forming apparatus 1. Furthermore, the toner cartridge 50 is removably attached to an end of the process cartridge 100 opposite to the end to which the photoconductor drum 31, retained by the photoconductor unit 30, is attached.

Thus, the toner cartridge 50 may be attached to or removed from the process cartridge 100 that is either in a state pulled out of the image forming apparatus 1 or in a state attached to the image forming apparatus 1.

As shown in FIG. 3, the retaining part 120 having a shape of a semicylindrical recess, to which the toner cartridge 50 is attached, is provided at an end of the process cartridge 100 opposite to the end to which the photoconductor drum 31 is attached.

The retaining part 120 is provided with a semicylindrical lid body 121 that is movable along the outer circumference of the toner cartridge 50, via which the toner cartridge 50 is attached or removed. The lid body 121 is opened and closed (see arrows R1 and R2 in FIG. 3) by using a flat-plate-shaped operating part 122, which is provided in a projecting manner at an end of the toner cartridge 50 in the longitudinal direction.

As shown in FIG. 3, an agitator AG for stirring the toner TN, serving as an example of developer, is disposed in the toner cartridge 50 so as to be able to rotate. When the process cartridge 100 is attached to the image forming apparatus 1, a rotational driving force is transmitted from a driving source (not shown) provided in the image forming apparatus 1 to the agitator AG. Furthermore, the toner cartridge 50 has a discharge port 52, through which the toner TN that is transported while being stirred by the agitator AG is discharged, provided at the lower end thereof in an attached state.

By moving the lid body 121 in the direction indicated by the arrow R1 in FIG. 3, the retaining part 120 for retaining the toner cartridge 50 is opened, making it possible to attach the toner cartridge 50 to the retaining part 120. Thereafter, by moving the lid body 121 in the opposite direction, i.e., the direction indicated by the arrow R2 in FIG. 3, the retaining part 120 for retaining the toner cartridge 50 is closed, and the toner cartridge 50 is fixed at a predetermined position. At the same time, the shutter 53, serving as an example of an opening-and-closing member, provided on the toner cartridge 50 so as to be capable of being opened and closed, moves, opening the discharge port 52.

As shown in FIGS. 1 and 3, the process cartridge 100 is integrally provided with a toner supply part 130 that supplies toner TN from the toner cartridge 50 to the developing device 40. The toner supply part 130 includes a transport path 131 through which the toner TN is transported from the toner cartridge 50 to the developing device 40, and a transport member 132 that is disposed inside the transport path 131 and transports the toner TN toward the developing device 40. The transport path 131, which is formed in a cylindrical shape on the inside, is disposed so as to extend from the bottom of the toner cartridge 50 to the top of the developing device 40.

The transport path 131 has an opening 133 in the top surface at one end, from which the toner TN is received from the toner cartridge 50, and has an opening 134 (shown in FIG. 1) in the bottom surface at the other end, through which the toner TN transported through the transport path 131 is supplied to the developing device 40.

A body shutter 135 that moves with the lid body 121 is provided between the opening 133 and the discharge port 52 in the toner cartridge 50. The body shutter 135 opens or closes the opening 133 in the toner supply part 130 when the toner cartridge 50 is attached or removed.

2.2 Configuration of Toner Cartridge

The toner cartridge 50 includes a toner container 51, serving as an example of a container body that stores the toner TN, and the shutter 53.

The toner container 51 is a tubular hollow container for the toner TN. The toner container 51 has, at one end thereof in the longitudinal direction and on the lower side, the discharge port 52, through which the toner TN contained in the toner container 51 is discharged, and a frame 54, having a pair of guide portions 54*a*, that supports the shutter 53 so as to be movable relative to the discharge port 52. Although the discharge port 52 has a rectangular shape in this exemplary embodiment, the shape of the discharge port 52 is not limited thereto, but may be other shapes, such as a polygonal shape and an elliptical shape.

The shutter 53 opens and closes the discharge port 52. As shown in FIGS. 4 to 6, the shutter 53 includes a closed portion 53A that closes the discharge port 52, an opening 53B via which the discharge port 52 and the opening 133 communicate with each other, and guided portions 53C supported by the guide portions 54*a*. The closed portion 53A is provided with a through-hole 53Ab at the end opposite to the end provided with the opening 53B. The through-hole 53Ab is engaged with a projection 121*a* (shown in FIG. 3) formed on the inner surface of the lid body 121, thus moving the shutter 53 between the closed position and the open position, along with the movement of the lid body 121.

As shown in FIG. 5E, a leading end 53Aa of the closed portion 53A, in the moving direction toward the closed position, has a tapered portion, serving as an example of an inclined portion, with which curling up of the scraping member 55 (described below), caused by the shutter 53 that moves in contact with the scraping member 55, is suppressed.

As shown in FIGS. 7A and 7B, a sealing member 56, serving as an example of a first elastic member, formed of polyurethane foam so as to surround the discharge port 52 from outside is attached to the frame 54 such that it projects toward the inner surface of the shutter 53. The sealing member 56 is elastically deformed between the toner container 51 and the shutter 53, thereby sealing the gap between the discharge port 52 and the shutter 53, suppressing leakage of the toner TN.

The scraping member 55, serving as an example of a second elastic member, formed of polyurethane foam is provided at an end of the discharge port 52, in the direction in which the shutter 53 moves when the discharge port 52 is closed. An end 55*a* of the scraping member 55 projects out of the travelling path of the inner surface of the shutter 53 (shown in FIG. 3) when the shutter 53 is located at the open position, that is, when the inner surface of the shutter 53 is not in contact with the scraping member 55.

A support portion 51*a* (shown in FIG. 3) standing upright toward the outside from the cylindrical wall of the toner container 51 is provided at one end of the discharge port 52, and the scraping member 55 is attached to the support portion 51*a* in such a manner that the end 55*a* thereof (shown in FIG. 3) is freely supported.

More specifically, as shown in FIG. 7A, the scraping member 55 is formed integrally with the sealing member 56 and, in a state in which it is separated from an attached portion of the sealing member 56 at cut portions L1 provided at both sides of the discharge port 52 in a direction intersecting the moving direction of the shutter 53 and in which it projects out of the travelling path of the inner surface of the shutter 53, is located at a position overlapping or on the inner side of the travelling path of the outer surface of the shutter 53 (shown in FIG. 3).

Note that the scraping member 55 does not necessarily have to be formed integrally with the sealing member 56, but may be formed as a rectangular elastic member, in plan view, and attached to the sealing member 56 at both sides of the discharge port 52 in a direction intersecting the moving direction of the shutter 53.

When the shutter 53 moves from the open position to the closed position (see the arrow in FIG. 7B), the scraping member 55 comes into contact with the inner surface of the closed portion 53A of the shutter 53 and, as the shutter 53 moves, scrapes off the toner TN that is pressed by the leading end 53Aa of the shutter 53.

The scraping member 55 is provided with an end-sealing member 57 that projects out from the travelling path of the shutter 53, on the top surface thereof at one end in the direction in which the shutter 53 moves when the discharge port 52 is closed. When the shutter 53 is located at the closed position, the end-sealing member 57 is in contact with the leading end 53Aa of the closed portion 53A and suppresses leakage of the toner TN.

First Modification

Figure 8A:
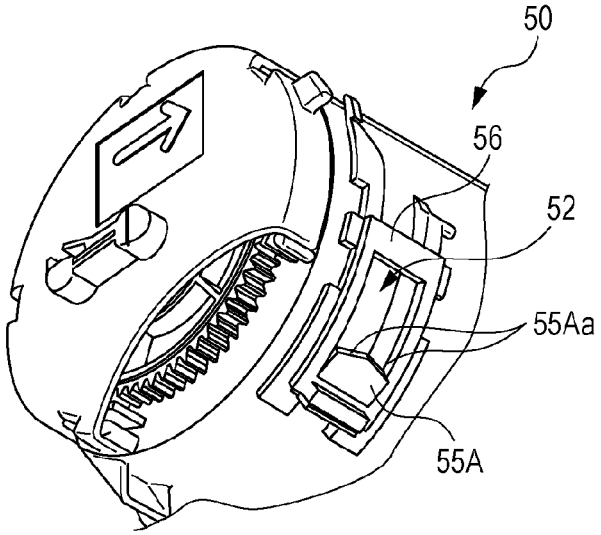
FIGS. 8A to 8C are perspective views of scraping members according to modifications of the toner cartridge.
Figure 8B:
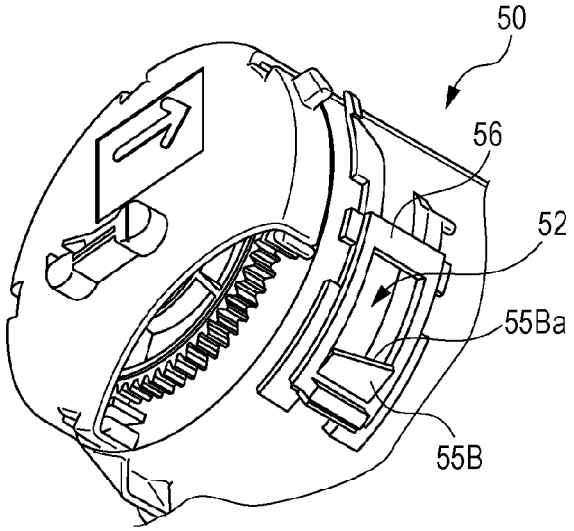
Figure 8C:
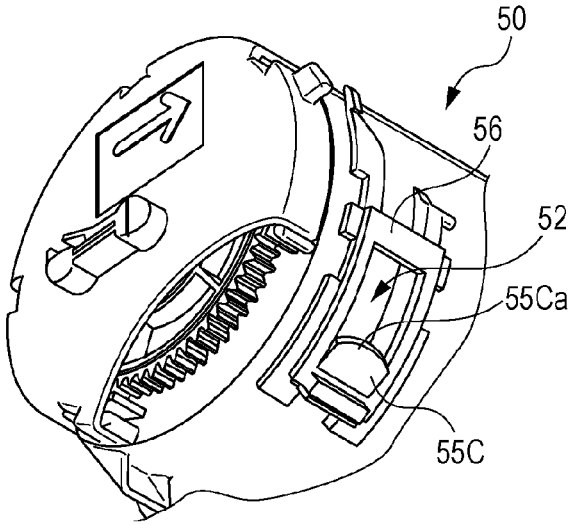

FIGS. 8A to 8C are perspective views of the scraping members 55A, 55B, and 55C, respectively, according to modifications of the toner cartridge 50.

As shown in FIG. 8A, the toner cartridge 50 is provided with the scraping member 55A, serving as an example of a second elastic member, at one end of the discharge port 52 in the direction in which the shutter 53 moves when the discharge port 52 is closed. The scraping member 55A has a freely supported pointed leading end 55Aa.

The scraping member 55A having the pointed leading end 55Aa scrapes off the toner TN that is pressed by the leading end 53Aa of the shutter 53 when the shutter 53 moves toward the closed position. Because the leading end 55Aa is pointed, the sliding resistance with respect to the shutter 53 that is moving toward the closed position is further reduced.

As shown in FIG. 8B, the scraping member 55B has a freely supported oblique leading end 55Ba.

As shown in FIG. 8C, the scraping member 55C has a freely supported rounded leading end 55Ca.

These scraping members 55B and 55C further reduce the sliding resistance with respect to the shutter 53 that is moving toward the closed position.

Second Modification

Figure 9A:
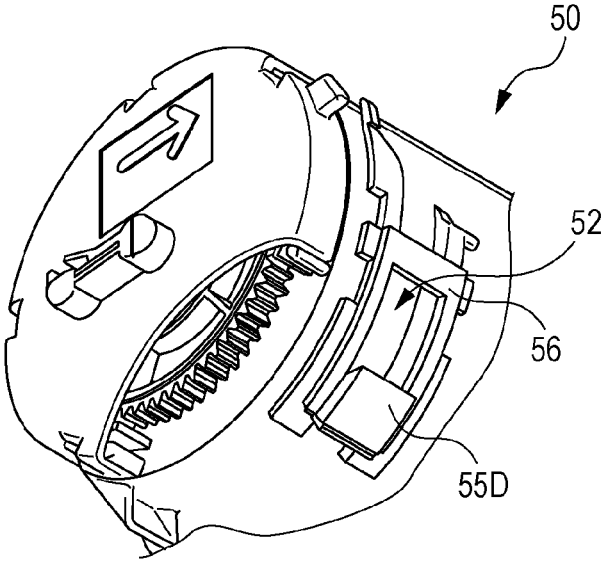
FIG. 9A is a perspective view of a scraping member according to another modification of the toner cartridge.
Figure 9B:
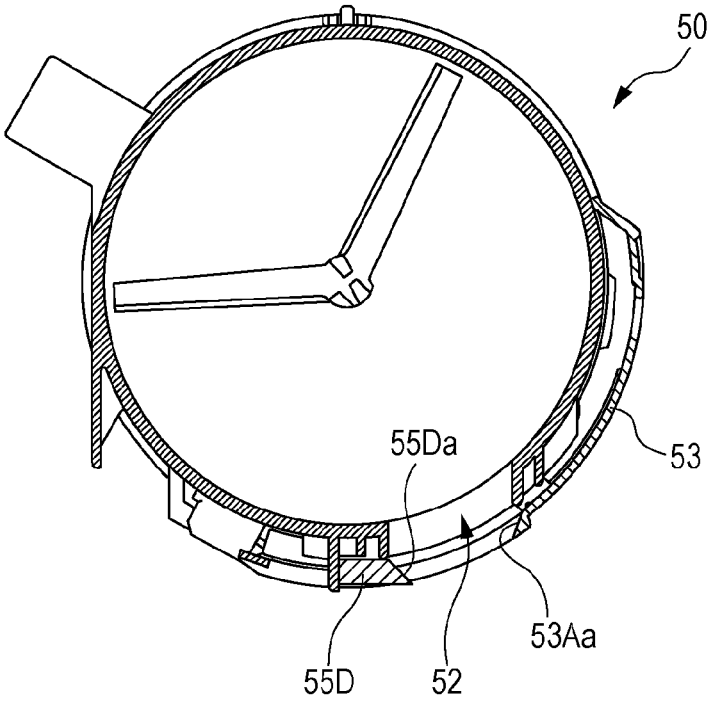
FIG. 9B is a schematic sectional view thereof.

FIG. 9A is a perspective view of a scraping member 55D according to another modification of the toner cartridge 50, and FIG. 9B is a schematic sectional view thereof.

The toner cartridge 50 is provided with the scraping member 55D, serving as an example of a second elastic member, at one end in the direction in which the shutter 53 moves when the discharge port 52 is closed. The scraping member 55D has a block shape as a whole, and a leading end 55Da thereof is formed in a tapered shape in section.

With the scraping member 55D having the leading end 55Da that is tapered in section, because the tapered leading end comes into contact with the inner surface of the closed portion 53A of the shutter 53 when the shutter 53 moves toward the closed position, it is possible to more reliably scrape off the toner TN pressed by the leading end 53Aa of the shutter 53, while further reducing the sliding resistance with respect to the shutter 53 that is moving toward the closed position.

3. Closing Operation of Shutter

Figure 10A:
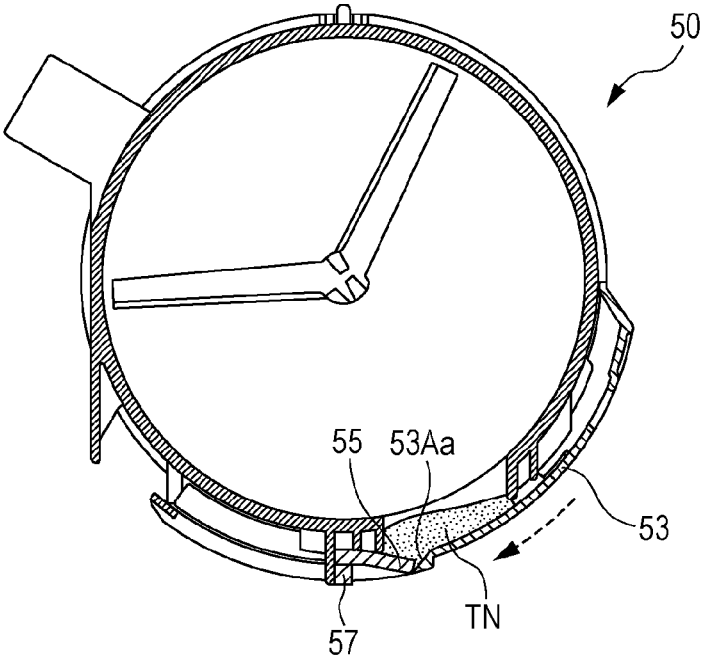
FIGS. 10A and 10B are schematic sectional views showing the movement of the shutter in the toner cartridge, from an open position to a closed position.
Figure 10B:
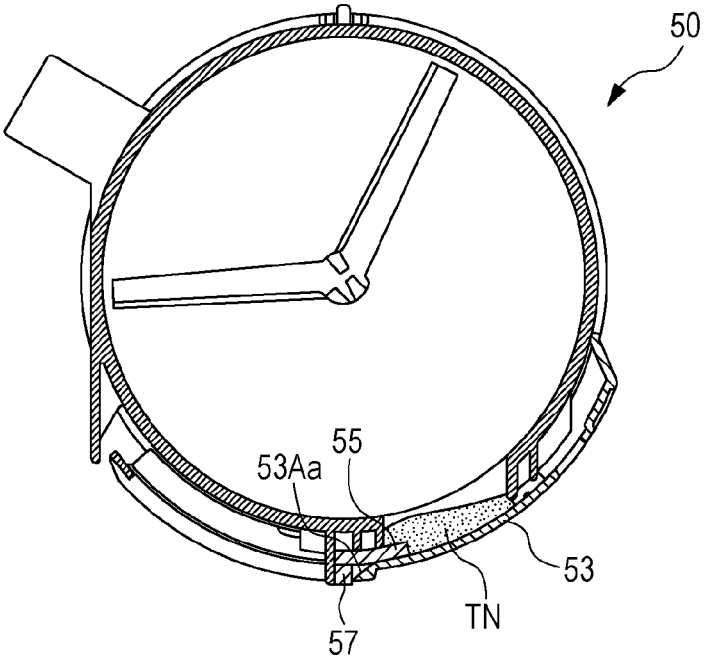
Figure 11A:
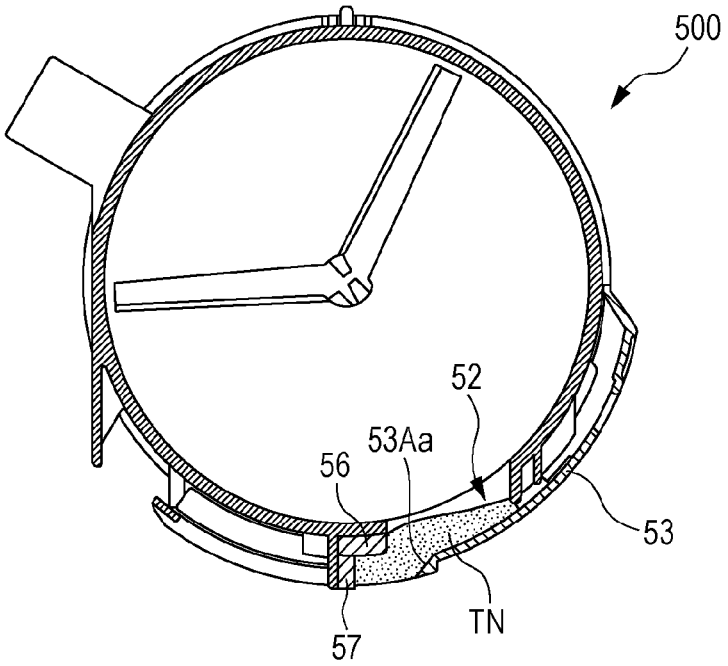
FIGS. 11A and 11B are schematic sectional views showing the movement of a shutter in a toner cartridge according to a comparative example, from an open position to a closed position.
Figure 11B:
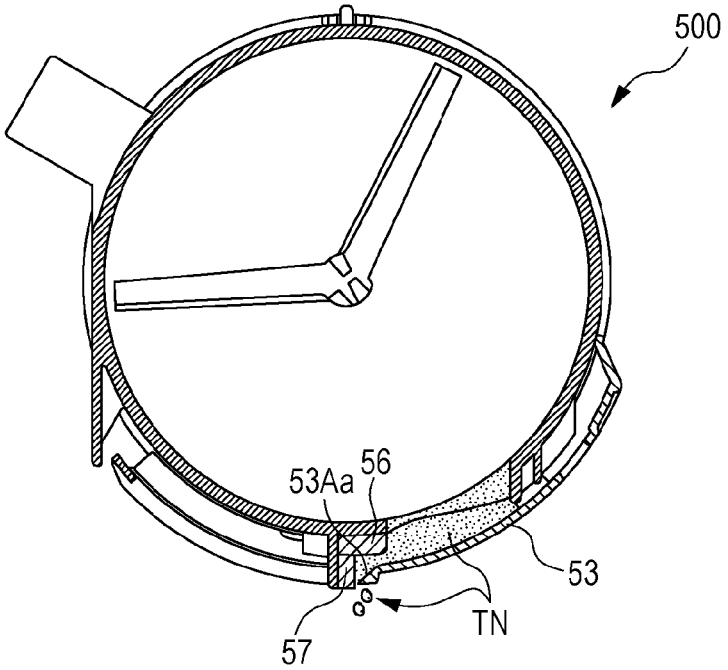

FIGS. 10A and 10B are schematic sectional views showing the movement of the shutter 53 on the toner cartridge 50 according to this exemplary embodiment, from the open position to the closed position, and FIGS. 11A and 11B are schematic sectional views showing the movement of the shutter 53 on a toner cartridge 500 according to a comparative example, from the open position to the closed position.

Referring to these figures, the closing operation of the shutter 53 will be described.

3.1 Toner Cartridge According to Comparative Example

In the toner cartridge 500 according to the comparative example, a sealing member 56 that is formed of polyurethane foam so as to surround the discharge port 52 from outside is attached to the frame 54 such that it projects toward the inner surface of the shutter 53, and an end-sealing member 57 is provided at one end of the sealing member 56 such that it projects out from the travelling path of the shutter 53.

When the toner cartridge 500 that has been attached to the retaining part 120 of the process cartridge 100 and used is removed from the process cartridge 100, the lid body 121 is moved (in the direction indicated by the arrow R1 in FIG. 3). As a result, the retaining part 120 of the toner cartridge 500 is opened, and the shutter 53, which is provided on the toner cartridge 500 in a manner capable of being opened and closed, moves so as to close the discharge port 52, closing the discharge port 52. Furthermore, the body shutter 135 (shown in FIG. 3) on the process cartridge 100 also moves simultaneously with the shutter 53 on the toner cartridge 500 and closes the opening 133.

The space around the discharge port 52 is filled with the toner TN discharged from the discharge port 52, and, when the shutter 53 moves toward the closed position, the leading end 53Aa of the closed portion 53A of the shutter 53 presses the toner TN toward the end-sealing member 57. When the shutter 53 is located at the closed position, the pressed toner TN is sandwiched between the leading end 53Aa and the end-sealing member 57 (see FIG. 11B).

If the toner cartridge 500 is removed from the retaining part 120 in this state, the toner TN between the leading end 53Aa and the end-sealing member 57 may fall and scatter.

3.2 Toner Cartridge According to Exemplary Embodiment

In the toner cartridge 50 according to this exemplary embodiment, the end 55*a* of the scraping member 55 is formed such that it projects out from the travelling path of the inner surface of the shutter 53, at one end of the discharge port 52 in the direction in which the shutter 53 moves when the discharge port 52 is closed. Furthermore, the end 55*a* is located at a position overlapping or inside the travelling path of the outer surface of the shutter 53.

Also in the toner cartridge 50, when the shutter 53 moves toward the closed position, the leading end 53Aa of the closed portion 53A of the shutter 53 presses the toner TN. However, after the tapered portion of the leading end 53Aa comes into contact with the scraping member 55, the scraping member 55 comes into contact with the inner surface of the shutter 53 and scrapes off the toner TN.

As a result, in a state in which the shutter 53 has moved to the closed position and is in contact with the end-sealing member 57, the amount of residual toner TN between the leading end 53Aa and the end-sealing member 57 is reduced, thus suppressing scattering of the toner TN when the toner cartridge 50 is removed from the retaining part 120.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developer container comprising:

a container body configured to contain developer to be supplied to an apparatus body, wherein the container body is attachable to and removable from the apparatus body, and wherein the container body comprises a discharge port through which the developer may be discharged;

an opening-and-closing member configured to open and close the discharge port in response to relative attachment and removal of the container body to and from the apparatus body;

a first elastic member that surrounds the discharge port and seals between the container body and the opening-and-closing member; and a second elastic member that contacts a leading end of the opening-and-closing member in a direction in which the opening-and-closing member moves along a travelling path toward the discharge port closing, wherein the second elastic member is a projection having a leading end that projects into the travelling path of the opening-and-closing member, at cut portions provided on both sides of the discharge port, in a direction parallel the direction in which the opening-and-closing member moves and a cut portion that is provided in a direction intersecting the direction in which the opening-and-closing member moves, and wherein the second elastic member is formed integrally with the first elastic member and is partially separated from the first elastic member by the cut portions provided internally relative to a perimeter of the first elastic member.

2. The developer container according to claim 1, wherein, in a state in which the opening-and-closing member is located at an open position, the second elastic member projects out of the travelling path of the opening-and-closing member.

3. The developer container according to claim 1, wherein, in a state in which the opening-and-closing member is located at an open position, the second elastic member is located at a position overlapping or inside the travelling path of an outer surface of the opening-and-closing member.

4. The developer container according to claim 2, wherein, in the state in which the opening-and-closing member is located at the open position, the second elastic member is located at a position overlapping or inside the travelling path of an outer surface of the opening-and-closing member.

5. The developer container according to claim 1, wherein, in a state in which the opening-and-closing member is located at a closed position, the second elastic member is pressed by the opening-and-closing member and is positioned inside the container body.

6. The developer container according to claim 1, wherein the leading end of the second elastic member, which faces the opening-and-closing member that moves toward a closed position, has a pointed shape.

7. The developer container according to claim 1, wherein the leading end of the second elastic member, which faces the opening-and-closing member that moves toward a closed position, has a rounded shape.

8. The developer container according to claim 1, wherein the leading end of the second elastic member, which faces the opening-and-closing member that moves toward a closed position, is a block member having an inclined portion.

9. The developer container according to claim 1, wherein the opening-and-closing member has an inclined portion on an inner surface, on the discharge port side, of the leading end of the opening-and-closing member in a direction toward a closed position.

10. The developer container according to claim 1, wherein the first elastic member and the second elastic member are formed of polyurethane foam.

11. An image forming apparatus comprising:

an image carrier configured to carry an electrostatic latent image;

a developing part configured to develop, with the developer, the electrostatic latent image on the image carrier;

the developer container according to claim 1, wherein the developer container is configured to contain the developer; and a transport part configured to transport the developer from the developer container to the developing part.

* * * * *